US010590708B2

(12) United States Patent
Liu et al.

(10) Patent No.: US 10,590,708 B2
(45) Date of Patent: Mar. 17, 2020

(54) MECHANICS EXPERIMENT SYSTEM AND METHOD FOR PERFORATED STRING IN UNDERGROUND PERFORATING BLASTING OF OIL-GAS WELL

(71) Applicant: SOUTHWEST PETROLEUM UNIVERSITY, Chengdu (CN)

(72) Inventors: Jun Liu, Chengdu (CN); Xiaoqiang Guo, Chengdu (CN); Qingyou Liu, Chengdu (CN); Guorong Wang, Chengdu (CN); Haiyan Zhu, Chengdu (CN); Xian Liu, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 183 days.

(21) Appl. No.: 15/744,891

(22) PCT Filed: Feb. 27, 2017

(86) PCT No.: PCT/CN2017/075032
§ 371 (c)(1),
(2) Date: Jan. 15, 2018

(87) PCT Pub. No.: WO2018/148985
PCT Pub. Date: Aug. 23, 2018

(65) Prior Publication Data

US 2019/0010760 A1 Jan. 10, 2019

(30) Foreign Application Priority Data

Feb. 14, 2017 (CN) ..... 2017 1 0077522

(51) Int. Cl.
*E21B 43/116* (2006.01)
*E21B 7/06* (2006.01)
(Continued)

(52) U.S. Cl.
CPC ..... *E21B 7/061* (2013.01); *E21B 43/117* (2013.01); *E21B 47/12* (2013.01)

(58) Field of Classification Search
CPC ..... E21B 43/11–43/1195
See application file for complete search history.

(56) References Cited

U.S. PATENT DOCUMENTS

2007/0081903 A1 4/2007 Khomynets

FOREIGN PATENT DOCUMENTS

CN 104265266 A 1/2015
CN 204329720 U 5/2015
(Continued)

OTHER PUBLICATIONS

PCT CN2017/075032 Writen Opinion English translation (dated Year: 2017).*

*Primary Examiner* — William D Hutton, Jr.
*Assistant Examiner* — Steven A MacDonald
(74) *Attorney, Agent, or Firm* — Bayramoglu Law Offices LLC

(57) ABSTRACT

A mechanics experiment system for a perforated string in underground perforating blasting of an oil-gas well. The system includes an experiment water pool, a perforated string arranged in the experiment water pool, a signal amplifier, an A/D converter and a computer. The signal amplifier, the A/D converter and the computer are arranged outside the experiment water pool and are sequentially electrically connected; the perforated string includes an oil pipe, a packing tube, a sleeve, an acceleration testing short joint A, a damper, an acceleration testing short joint B and a perforating gun which are sequentially connected from top to bottom.

6 Claims, 6 Drawing Sheets

(51) Int. Cl.
*E21B 43/117* (2006.01)
*E21B 47/12* (2012.01)

(56) References Cited

FOREIGN PATENT DOCUMENTS

| | | | |
|---|---|---|---|
| CN | 105091662 | A | 11/2015 |
| CN | 105352696 | A | 2/2016 |
| GB | 2093091 | B | 2/1985 |

* cited by examiner

MECHANICS EXPERIMENT SYSTEM AND METHOD FOR PERFORATED STRING IN UNDERGROUND PERFORATING BLASTING OF OIL-GAS WELL

CROSS REFERENCE TO RELATED APPLICATIONS

This application is the national phase entry of International Application No. PCT/CN2017/075032, filed on Feb. 27, 2017, which claims priority from the Chinese patent application no. 201710077522.5 filed on Feb. 14, 2017, the entire contents of which are incorporated herein by reference.

TECHNICAL FIELD

The present invention relates to the technical field of well logging in a development process of an oil and gas field, and in particular to a mechanics experiment system and method for a perforated string in underground perforating blasting of an oil-gas well.

BACKGROUND

The purpose of perforation operations is to make a passage between a shaft and an oil-gas reservoir, which is the key link in oil and gas field exploitation. The development and perfection of the perforation technology have important practical significance and practical value to high-efficiency oil and gas field exploitation.

Perforation completion of oil and gas pipes is a completion method in which a perforating gun underground fires a perforating bullet to shot through an oil-string casing and a cement sheath and perforate through an oil reservoir to a certain depth to establish a passage of oil flow, thereby improving the energy production efficiency. However, during perforation, the explosion shock waves of the perforating bullet and the pulsation energy generated by high pressure bubbles resulting from explosion can deform a tubing string. Strong deformation will lead to the fracture of a clamping column and a center tube of a packer, plastic bending damage or failure of an oil pipe and other underground accidents, and therefore, it is very important to study the underground pressure field when perforating.

At present, in the actual oil-well perforation operations, it is frequent to connect a perforating gun having a gun body to the tail of an oil pipe and transmit the same to a perforation operation layer for a perforation operation. Compared with a cable delivery perforation operation, the oil pipe delivery perforation operation has the following advantages: small damage occurs to the oil-gas reservoir; the gun body is centralized well in the well; high porosity, multiphase and large aperture perforation can be performed; the oil pipe delivery perforation operation can be in cooperation with the formation test, acid fracturing and the like. However, compared with the cable delivery operations, the oil pipe delivery perforation operation has the defects in the perforation detonation way. Cable transmission is used in electric fire firing, while the oil pipe delivery operation has more complicated detonation ways at present: gravity detonation; oil pipe pressurized detonation; annulus pressurized detonation. However, the researches at home and abroad mainly focus on numerical simulation of static and dynamic mechanics, the necessary experimental methods and research methods are not perfect, and the traditional simulation and test methods are difficult to test the dynamic response of strings completely.

SUMMARY

The objectives of the present invention are to overcome the shortcomings of the prior art, acquire the dynamic data of an underground pressure field during perforating, including an annulus pressure field, and the radial, axial and circumferential acceleration time domain variation value of a string during perforating, provide the analyzing basis to analyze a underground accident occurrence mechanism of perforating, and guide the construction and work to avoid accidents, and therefore there are provided a mechanics experiment system and method for a perforated string in underground perforating blasting of an oil-gas well, which are of important significance in ensuring the string intensity demand and increasing the oil yield and are simple in experimental operations.

An objective of the present invention is realized by the following technical solution: a mechanics experiment system for a perforated string in underground perforating blasting of an oil-gas well, comprising an experiment water pool, a perforated string arranged in the experiment water pool, a signal amplifier, an A/D converter and a computer, wherein the signal amplifier, the A/D converter and the computer are arranged outside the experiment water pool and are sequentially electrically connected;

the perforated string comprises an oil pipe, a packing tube, a sleeve, an acceleration testing short joint A, a damper, an acceleration testing short joint B and a perforating gun which are sequentially connected from top to bottom; the lower end of the sleeve is provided with an outer thread; the acceleration testing short joint A and the acceleration testing short joint B are identical in structure; the acceleration testing short joint A comprises a cylindrical head and a threaded head; the threaded head is fixedly connected to the bottom of the cylindrical head; the top end of the cylindrical head is provided with a threaded hole A; the bottom of the threaded head is sequentially provided with a disc and an acceleration mounting frame; the left side and the right side of the acceleration mounting frame are planes; the left plane and the right plane are respectively provided with a radial acceleration sensor; right angles which are staggered from each other are respectively arranged at the front side and the rear side of the acceleration mounting frame; a circumferential acceleration sensor is respectively mounted on the two right angles; the disc is provided with an axial acceleration sensor; the acceleration mounting frame is provided with a through hole A which is communicated with the threaded hole A;

the damper comprises a barrel, an upper end cover and a lower end cover which are arranged in the barrel and positioned at the upper end and the lower end, a damping spring arranged in the barrel, a sliding sleeve and a guide shaft; the barrel is internally provided with a threaded hole B which is located above the upper end cover; the guide shaft is connected with the upper end cover; the guide shaft is internally provided with a through hole B which is communicated with the threaded hole B; the sliding sleeve sleeves the guide shaft and penetrates through the lower end cover; an extending-out end of the sliding sleeve is provided with an outer thread; the guide shaft is also sleeved with the damping spring which is pressed against between the sliding sleeve and the upper end cover;

the outer thread of the sleeve is in threaded connection with the threaded hole A of the acceleration testing short joint A; the threaded head of the acceleration testing short joint A is in threaded connection with the threaded hole B of the barrel; the outer thread of the sliding sleeve is in threaded connection with the threaded hole A of the acceleration testing short joint B; the threaded head of the acceleration testing short joint B is connected with the perforating gun;

the pressure sensor, the radial acceleration sensor, the circumferential acceleration sensor and the axial acceleration sensor are electrically connected with the signal amplifier respectively.

The oil pipe and the packing tube are locked by an oil pipe hoop.

The packing tube and the sleeve are locked by a sleeve hoop.

A tripod is arranged in the experiment water pool, the perforated string is positioned in a region defined by the tripod, and the tripod is connected with a hoop via a connecting rod.

Both the threaded hole A and the threaded hole B are coaxial threaded holes.

A mechanics experiment method for a perforated string in underground perforating blasting of an oil-gas well, which is implemented by the system, comprises the following steps:

S1, charging a perforating bullet to the perforating gun according to standards;

S2, setting the perforated string down to the experiment water pool, connecting an output wire of each sensor to the signal amplifier while moving down to a certain depth, then connecting the signal amplifier to the A/D converter, and finally connecting the A/D converter to the computer;

S3, testing and regulating the signal amplifier such that the whole experiment system are in a pending state;

S4, detonating the perforating bullet on the perforating gun by a detonating line; acquiring, via the pressure sensor, an instantaneous pressure field suffered by the perforated string; transmitting, via the pressure sensor, the data to the signal amplifier; then transmitting, via the signal amplifier, the data to the A/D converter; and converting, via the A/D converter, a pressure signal into an electric signal, and then transmitting the electric signal to the computer for storage; acquiring, via the radial acceleration sensor, the circumferential acceleration sensor and the axial acceleration sensor, an radial acceleration, a circumferential acceleration and an axial acceleration of the perforated string respectively, and transmitting, via the acceleration sensors, the data to the signal amplifier; then transmitting, via the signal amplifier, the data to the A/D converter, and converting, via the A/D converter, an acceleration signal into an electric signal and then converting the electric signal to the computer for storage; and S5, calculating, via the computer, a speed variation curve and a displacement variation curve of the perforated string during the perforation operation according to the acquired acceleration data; calculating, via the computer, a pressure variation curve of the perforated string during the perforation operation according to the acquired pressure data; and finally, obtaining a failure mechanism of the perforated string after the perforation operation by analyzing the curves, in order to ensure the strength demand of the string and have a positive meaning to improve the oil yield.

The system and the method of the present invention have the following advantages: the defect that traditional simulation and test methods are difficult to test the dynamic response of the string is overcome; the dynamic data of an underground pressure field can be acquired during perforating, including an annulus pressure field, and the radial, axial and circumferential acceleration time domain variation value of the string during perforating, thus the analyzing basis is provided to analyze underground accident occurrence mechanism of perforating; the construction and work are guided to avoid accidents; the system and the method are of important significance in ensuring the string intensity demand and increasing the oil yield.

Figure 1:
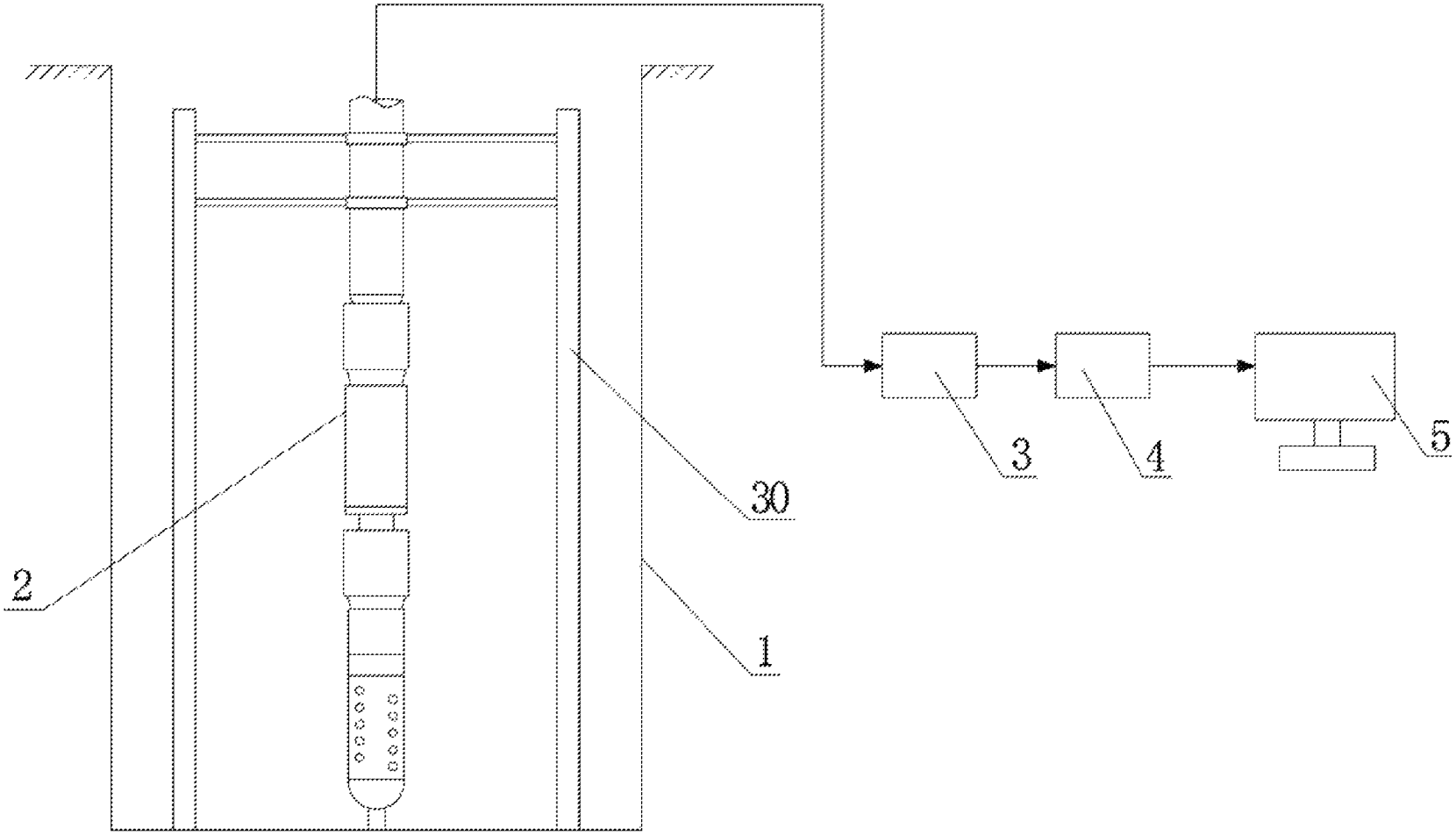
FIG. 1 is a structural schematic drawing of the present invention.
Figure 2:
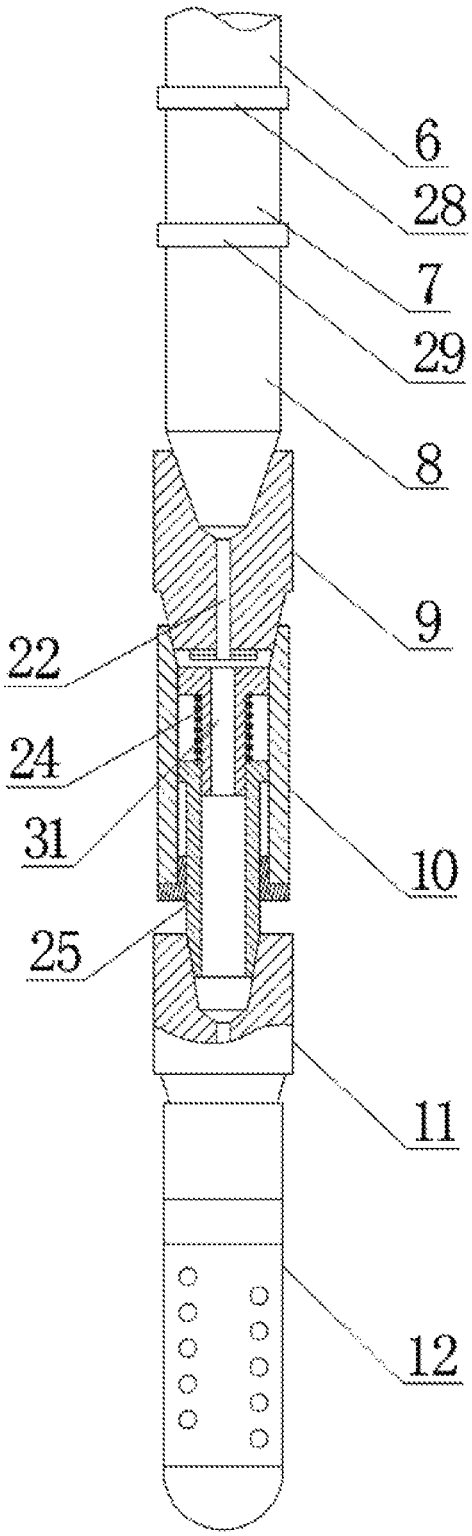
FIG. 2 is a structural schematic drawing of a perforated string.
Figure 3:
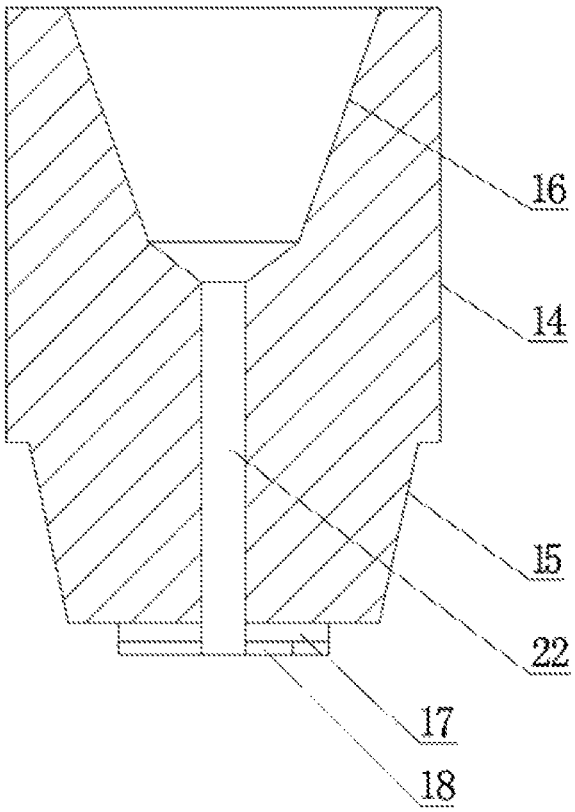
FIG. 3 is a structural schematic drawing of an acceleration testing short joint A.
Figure 4:
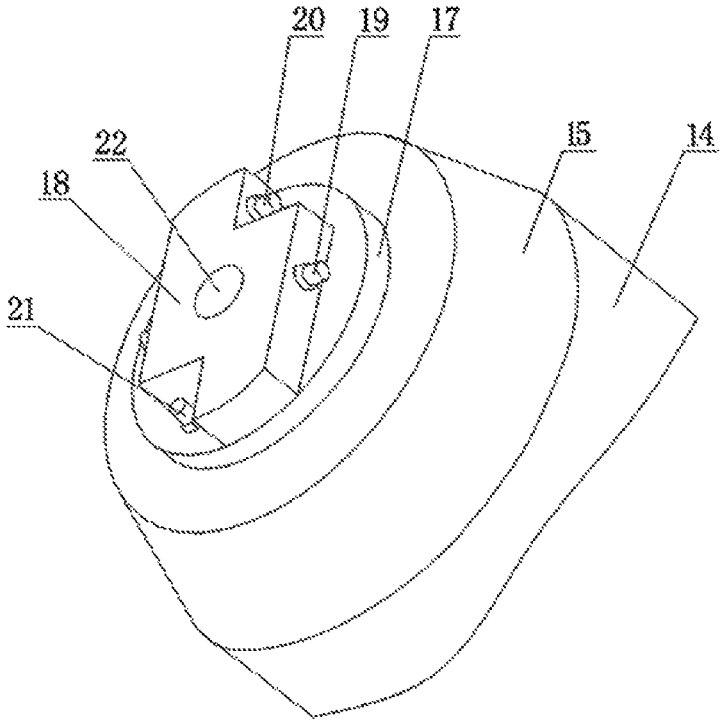
FIG. 4 is a schematic installation drawing of an acceleration sensor and the acceleration testing short joint A.
Figure 5:
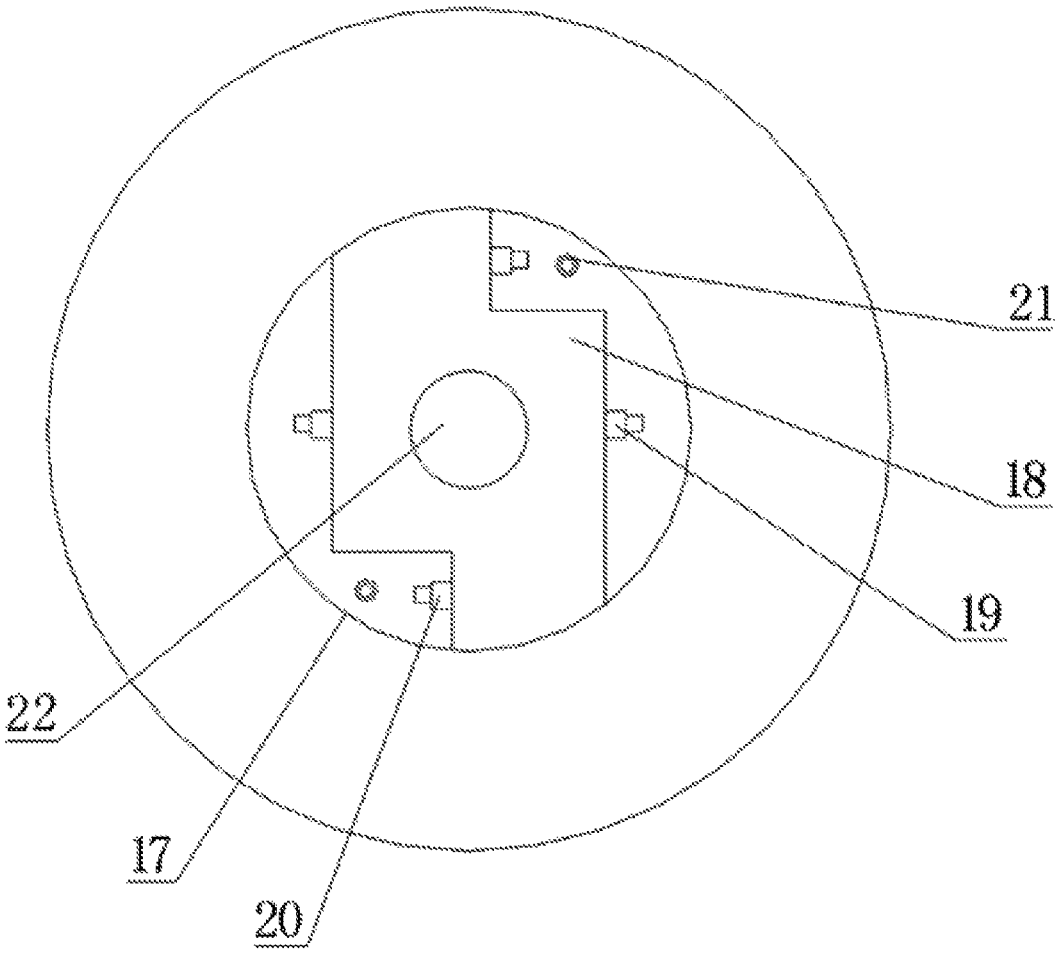
FIG. 5 is a top view of FIG. 4.
Figure 6:
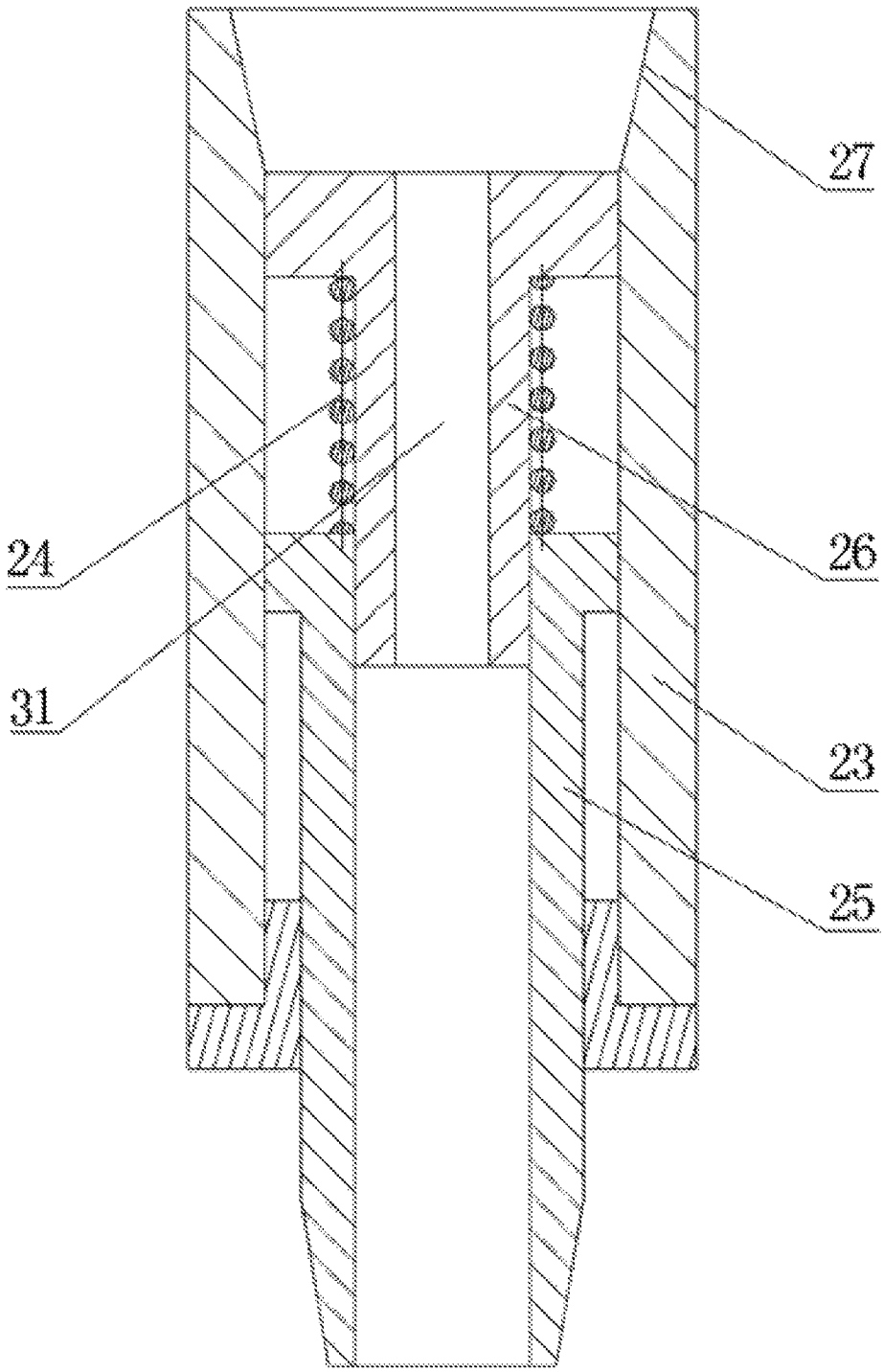
FIG. 6 is a structural schematic drawing of a damper.
Figure 7:
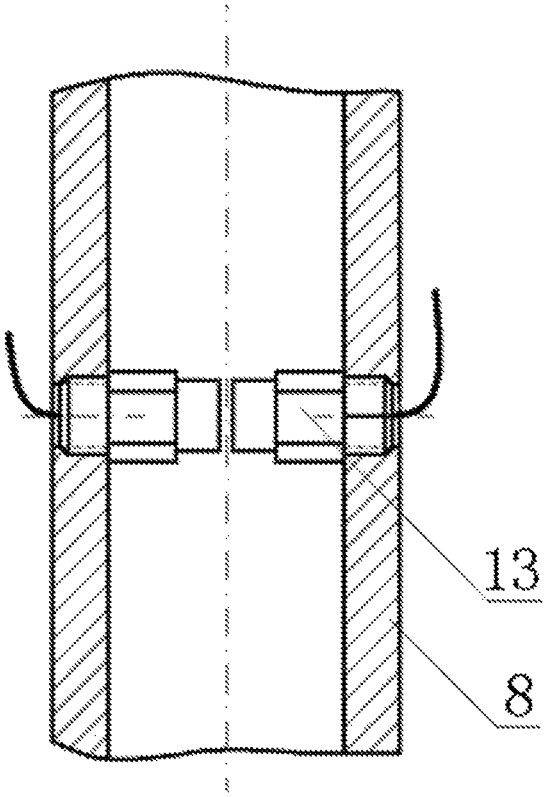
FIG. 7 is a schematic installation drawing of a pressure sensor and a sleeve.

in drawings, the reference signs represent the following components: 1—experiment water pool; 2—perforated string; 3—signal amplifier; 4—A/D converter; 5—computer; 6—oil pipe; 7—packing tube; 8—sleeve; 9—acceleration testing short joint A; 10—damper; 11—acceleration testing short joint B; 12—perforated gun; 13—pressure sensor; 14—cylindrical head; 15—threaded head; 16—threaded hole A; 17—disc; 18—acceleration mounting frame; 19—radial acceleration sensor; 20—circumferential acceleration sensor; 21—axial acceleration sensor; 22—through hole A; 23—barrel; 24—damping spring; 25—sliding sleeve; 26—guide shaft; 27—threaded hole B; 28—oil pipe hoop; 29—sleeve hoop; 30—tripod; 31—through hole B.

DETAILED DESCRIPTION OF THE EMBODIMENTS

The present invention will be further described as below in conjunction with the drawings. The protection scope of the present invention is not limited to the following content.

As shown in FIGS. 1 to 7, a mechanics experiment system for a perforated string in underground perforating blasting of an oil-gas well comprises an experiment water pool 1, a perforated string 2 arranged in the experiment water pool 1, a signal amplifier 3, an A/D converter 4 and a computer 5, wherein the signal amplifier 3, the A/D converter 4 and the computer 5 are arranged outside the experiment water pool 1 and are sequentially electrically connected; the perforated string 2 comprises an oil pipe 6, a packing tube 7, a sleeve 8, an acceleration testing short joint A9, a damper 10, an acceleration testing short joint B11 and a perforating gun 12 which are sequentially connected from top to bottom; the oil pipe 6 and the packing tube 7 are locked by an oil pipe hoop 28, and the packing tube 7 and the sleeve 8 are locked by a sleeve hoop 29; a pressure sensor 13 is mounted in the sleeve 8; the lower end of the sleeve 8 is provided with an outer thread; the acceleration testing short joint A9 and the acceleration testing short joint B11 are identical in structure. The acceleration testing short joint A9 comprises a cylindrical head 14 and a threaded head 15; the threaded head 15 is fixedly connected to the bottom of the cylindrical head 14; the top end of the cylindrical head 14 is provided with a threaded hole A16; the bottom of the threaded head 15 is sequentially provided with a disc 17 and an acceleration mounting frame 18; the left side and the right side of the acceleration mounting frame 18 are planes; the left plane and the right plane are respectively provided with a radial acceleration sensor 19; right angles which are staggered from each other are respectively arranged at the front side and the rear side of the acceleration mounting frame 18; a circumferential acceleration sensor 20 is respectively mounted on the two right angles; the disc 17 is provided with an axial acceleration sensor 21; the acceleration mounting frame 18 is provided with a through hole A22 which is communicated with the threaded hole A16.

The damper 10 comprises a barrel 23, an upper end cover and a lower end cover which are arranged in the barrel and positioned at the upper end and the lower end, a damping spring 24 arranged in the barrel 23, a sliding sleeve 25 and a guide shaft 26; the barrel 23 is internally provided with a threaded hole B27 which is located above the upper end cover; the guide shaft 26 is connected with the upper end cover; the guide shaft 26 is internally provided with a through hole B31 which is communicated with the threaded hole B27; the sliding sleeve 25 sleeves the guide shaft 26 and penetrates through the lower end cover; an extending-out end of the sliding sleeve 25 is provided with an outer thread; the guide shaft 26 is also sleeved with the damping spring 24 which is pressed against between the sliding sleeve 25 and the upper end cover. When the perforating bullet on the perforating gun 12 is detonated, the acceleration testing short joint B11 moves upwards along with the sliding sleeve 25, and the sliding sleeve 25 moves upwards along the guide shaft 26. In the movement process, the sliding sleeve 25 compresses the damping spring 24 to prevent the shock generated on the perforating gun 12 from being directly delivered to the acceleration testing short joint A9 and causing the damage of the whole performed string, thereby taking a favorable damping effect and ensuring smooth proceeding of the experiment.

The outer thread of the sleeve 8 is in threaded connection with the threaded hole A16 of the acceleration testing short joint A9. Since the sleeve 8 is in threaded connection with the acceleration testing short joint A9, it is only necessary to change the structure at the lower part of the sleeve 8 when different experiments are made, such that the operation is very simple and convenient. The threaded head 15 of the acceleration testing short joint A9 is in threaded connection with the threaded hole B27 of the barrel 23; the outer thread of the sliding sleeve 25 is in threaded connection with the threaded hole A16 of the acceleration testing short joint B11; the threaded head 15 of the acceleration testing short joint B11 is connected with the perforating gun 12.

The pressure sensor 13, the radial acceleration sensor 19, the circumferential acceleration sensor 20 and the axial acceleration sensor 21 are electrically connected with the signal amplifier 3 respectively. A data line of the pressure sensor 13 sequentially passes through the sleeve 8, the packing tube 7 and the oil pipe 6, and is finally connected with the signal amplifier 3. A data line of each acceleration sensor on the acceleration testing short joint A9 sequentially passes through the through hole A22, the threaded hole A16, the sleeve 8, the packing tube 7 and the oil pipe 6 and is finally connected with the signal amplifier 3. A data line of each acceleration sensor on the acceleration testing short joint B11 sequentially passes through the sliding sleeve 25, the through hole B31, the acceleration testing short joint A9, the sleeve 8, the packing tube 7 and the oil pipe 6 and is finally connected with the signal amplifier. A detonation line of the perforated gun 12 sequentially passes through the acceleration testing short joint B11, the damper 10, the acceleration testing short joint A9, the sleeve 8, the packing tube 7 and the oil pipe 6 and is finally connected with the signal amplifier 3.

A tripod 30 is arranged in the experiment water pool 1, and the perforated string 2 is positioned in a region defined by the tripod 30, and the tripod 30 is connected with a hoop via a connecting rod. Both the threaded hole A16 and the threaded hole B27 are coaxial threaded holes, and therefore, the position of the tripod 30 can be changed during the experiment to achieve the influence of the position change of a packer on the mechanics response of the string during the perforation operation.

As shown in FIG. 1, a mechanics experiment method for a perforated string in underground perforating blasting of an oil-gas well, which is implemented by the system, comprises the following steps:

S1, charging a perforating bullet to the perforating gun 12 according to standards;

S2, setting the perforated string 2 down to the experiment water pool 1; connecting an output wire of each sensor to the signal amplifier 3 while moving down to a certain depth; then connecting the signal amplifier 3 to the A/D converter 4; and finally connecting the A/D converter 4 to the computer 5;

S3, testing and regulating the signal amplifier 3 such that the whole experiment system are in a pending state;

S4, detonating the perforating bullet on the perforating gun 12 by a detonating line; acquiring, via the pressure sensor 13, an instantaneous pressure field suffered by the perforated string 2; transmitting, via the pressure sensor 13, the data to the signal amplifier 3; then transmitting, via the signal amplifier 3, the data to the A/D converter 4, and converting, via the A/D converter 4, a pressure signal into an electric signal and then transmitting the electric signal to the computer 5 for storage; acquiring, via the radial acceleration sensor 19, the circumferential acceleration sensor 20 and the axial acceleration sensor 21, an radial acceleration, a circumferential acceleration and an axial acceleration of the perforated string 2 respectively; transmitting, via the acceleration sensors, the data to the signal amplifier 3; then transmitting, via the signal amplifier 3, the data to the A/D converter 4, and converting, via the A/D converter 4, an acceleration signal into an electric signal and then converting the electric signal to the computer 5 for storage;

S5, calculating, via the computer 5, a speed variation curve and a displacement variation curve of the perforated string 2 during the perforation operation according to the acquired acceleration data; calculating, via the computer 5, a pressure variation curve of the perforated string 2 during the perforation operation according to the acquired pressure data; and finally, obtaining a failure mechanism of the perforated string after the perforation operation by analyzing the curves, in order to ensure the strength demand of the string and have a positive meaning to improve the oil yield.

The foregoing contents are only preferred embodiments of the present invention and it is to be understood that the invention is not limited to the forms disclosed herein and should not be construed as an exclusion of other embodiments and may be used in various other combinations, modifications and environments and can be modified within the scope of the invention as described herein by the techniques or knowledge of the above teachings or related fields. Changes and modifications made by those skilled in the art without departing from the spirit and scope of the invention should fall within the scope of the appended claims.

The invention claimed is:

1. A mechanics experiment system for a perforated string in underground perforating blasting of an oil-gas well, comprising: an experiment water pool, a perforated string arranged in the experiment water pool, a signal amplifier, an A/D converter and a computer, wherein the signal amplifier, the A/D converter and the computer are arranged outside the experiment water pool and are sequentially electrically connected;

the perforated string comprises an oil pipe, a packing tube, a sleeve, a first acceleration testing short joint, a damper, a second acceleration testing short joint and a perforating gun sequentially connected from top to bottom; a lower end of the sleeve is provided with an outer thread; the first acceleration testing short joint and the second acceleration testing short joint are identical in structure; the first acceleration testing short joint comprises a cylindrical head and a threaded head; the threaded head is fixedly connected to the bottom of the cylindrical head; a top end of the cylindrical head is provided with a first threaded hole; a bottom of the threaded head is sequentially provided with a disc and an acceleration mounting frame; a left side and a right side of the acceleration mounting frame are planes; the left plane and the right plane are respectively provided with a radial acceleration sensor; two right angles which are staggered from each other are respectively arranged at a front side and a rear side of the acceleration mounting frame; a circumferential acceleration sensor is respectively mounted on the two right angles; the disc is provided with an axial acceleration sensor; the acceleration mounting frame is provided with a first through hole communicating with the first threaded hole;

the damper comprises a barrel, an upper end cover and a lower end cover arranged in the barrel and positioned at the upper end and the lower end, a damping spring arranged in the barrel, a sliding sleeve and a guide shaft; the barrel is internally provided with a second threaded hole located above the upper end cover; the guide shaft is connected with the upper end cover; the guide shaft is internally provided with a second through hole communicating with the second threaded hole; the sliding sleeve sleeves the guide shaft and penetrates through the lower end cover; an extending-out end of the sliding sleeve is provided with an outer thread; the guide shaft is also sleeved with the damping spring which is pressed against between the sliding sleeve and the upper end cover;

the outer thread of the sleeve is in threaded connection with the first threaded hole of the first acceleration testing short joint; the threaded head of the first acceleration testing short joint is in threaded connection with the second threaded hole of the barrel;

the outer thread of the sliding sleeve is in threaded connection with the first threaded hole of the second acceleration testing short joint; the threaded head of the second acceleration testing short joint is connected with the perforating gun;

a pressure sensor, the radial acceleration sensor, the circumferential acceleration sensor and the axial acceleration sensor are electrically connected with the signal amplifier respectively.

2. The mechanics experiment system for the perforated string in underground perforating blasting of the oil-gas well according to claim 1, wherein the oil pipe and the packing tube are locked by an oil pipe hoop.

3. The mechanics experiment system for the perforated string in underground perforating blasting of the oil-gas well according to claim 1, wherein the oil pipe and the sleeve are locked by a sleeve hoop.

4. The mechanics experiment system for the perforated string in underground perforating blasting of the oil-gas well according to claim 1, wherein a tripod is arranged in the experiment water pool; the perforated string is positioned in a region defined by the tripod, and the tripod is connected with a sleeve hoop or an oil pipe hoop via one or more connecting rods.

5. The mechanics experiment system for the perforated string in underground perforating blasting of the oil-gas well according to claim 1, wherein both the first threaded hole and the second threaded hole are conical threaded holes.

6. A mechanics experiment method for a perforated string in underground perforating blasting of an oil-gas well using a mechanics experiment system, comprising the following steps:

installing a perforating bullet on to a perforating gun;

setting a perforated string into an experiment water pool; connecting an output wire of a radial acceleration sensor, a circumferential acceleration sensor, an axial acceleration sensor and a pressure sensor to a signal amplifier while performing the step of setting the perforated string into the water pool, and then connecting the signal amplifier to an A/D converter; and finally connecting the A/D converter to a computer;

testing and regulating the signal amplifier such that the mechanics experiment system is in a pending state;

detonating the perforating bullet on the perforating gun by a detonating line;

acquiring, via the pressure sensor, an instantaneous pressure field suffered by the perforated string; transmitting, via the pressure sensor, pressure data to the signal amplifier; then transmitting, via the signal amplifier, the pressure data to the A/D converter, and converting, via the A/D converter, the pressure data into an electric signal and then transmitting the electric signal to the computer for storage; acquiring radial acceleration data, circumferential acceleration data and axial acceleration data of the perforated string via the radial acceleration sensor, the circumferential acceleration sensor and the axial acceleration sensor, respectively; transmitting, via the radial circumferential and axial acceleration sensors, the radial, circumferential and axial acceleration data to the signal amplifier; then transmitting, via the signal amplifier, the radial, circumferential and axial acceleration data to the A/D converter; and converting, via the A/D converter, the radial, circumferential and axial acceleration data into a second electric signal and then transmitting the second electric signal to the computer for storage; and calculating, via the computer, a speed variation curve and a displacement variation curve of the perforated string during a perforation operation according to the acquired radial, circumferential and axial acceleration data; calculating, via the computer, a pressure variation curve of the perforated string during the perforation operation according to acquired pressure data; and finally, determining a failure mechanism of the perforated string by analyzing the speed and displacement variation curves, to determine strength demands of the string.

* * * * *